United States Patent [19]

Pulkowski et al.

[11] Patent Number: 4,621,177

[45] Date of Patent: Nov. 4, 1986

[54] INDUCTOR CONFIGURATION FOR EDDY CURRENT HEATING IN THE PAPERMAKING PROCESS

[75] Inventors: Jeffrey H. Pulkowski, Beloit, Wis.; Steven J. Siler, Rockton, Ill.

[73] Assignee: Beloit Corporation, Beloit, Wis.

[21] Appl. No.: 716,535

[22] Filed: Mar. 27, 1985

[51] Int. Cl.[4] ..... H05B 6/40

[52] U.S. Cl. ..... 219/10.49 A; 219/10.61 A; 219/10.71; 219/10.79; 219/10.43; 100/92

[58] Field of Search ..... 219/10.49 R, 10.49 A, 219/10.61 R, 10.61 A, 10.57, 10.79, 10.71, 10.43; 336/182, 183; 100/92, 93 RP

[56] References Cited

U.S. PATENT DOCUMENTS

| | | | |
|---|---|---|---|
| 1,912,214 | 5/1933 | Northrup | 219/10.79 X |
| 2,761,941 | 9/1956 | Ardichvili | 219/10.49 |
| 4,304,975 | 12/1981 | Lenk et al. | 219/10.61 A X |
| 4,371,768 | 2/1983 | Pozna | 219/10.57 X |
| 4,384,514 | 5/1983 | Larivé et al. | 219/10.57 |
| 4,425,489 | 1/1984 | Pav et al. | 219/10.49 A |
| 4,486,962 | 12/1984 | Wedel | 34/110 |

FOREIGN PATENT DOCUMENTS

| | | |
|---|---|---|
| 489300 | 1/1930 | Fed. Rep. of Germany . |
| 2204816 | 8/1973 | Fed. Rep. of Germany . |
| 1453348 | 8/1966 | France . |

OTHER PUBLICATIONS

Publication in "Rubber World" Feb., 1954, pp. 621 and 622.

British Plastics Journal Nov. 1953, pp. 400 and 401.

Related application filed by assignee-Udiono Stedile Ser. No. 386,864, filed Jun. 10, 1982 claiming Convention filing date of Italian Application No. 67827-A/81, filed Jun. 16, 1981.

*Primary Examiner*—Philip H. Leung
*Attorney, Agent, or Firm*—Hill, Van Santen, Steadman & Simpson

[57] ABSTRACT

Inductors for heating rolls especially of the type used in rolling mills for sheet materials such as paper, textiles, plastics and the like, are configured to enhance and concentrate eddy currents in areas along the length of the roll to selectively heat the roll as desired and control moisture and caliper properties of the sheet. The inductors have cores with a center leg around which the exciting coil is wound and an outer leg surrounding the coil and connected at one end to the inner leg. These inductors or electromagnets are mounted immediately adjacent a roll of magnetic flux conducting material, such as iron or steel, to heat the roll surface as desired across the length of the roll as it is rotated through the concentrated electromagnetic field generated by the inductor. The magnetic field or flux is concentrated in an annular zone and passes between the nested inner and outer legs of the core through the roll without travelling through a wide air gap and the desired roll temperatures are achieved with minimum current input to the coil. The air gap may be varied in the cross machine direction and the excitation of the inductors may be varied to induce or compensate for temperature variations across the roll.

10 Claims, 7 Drawing Figures

FIG. 1
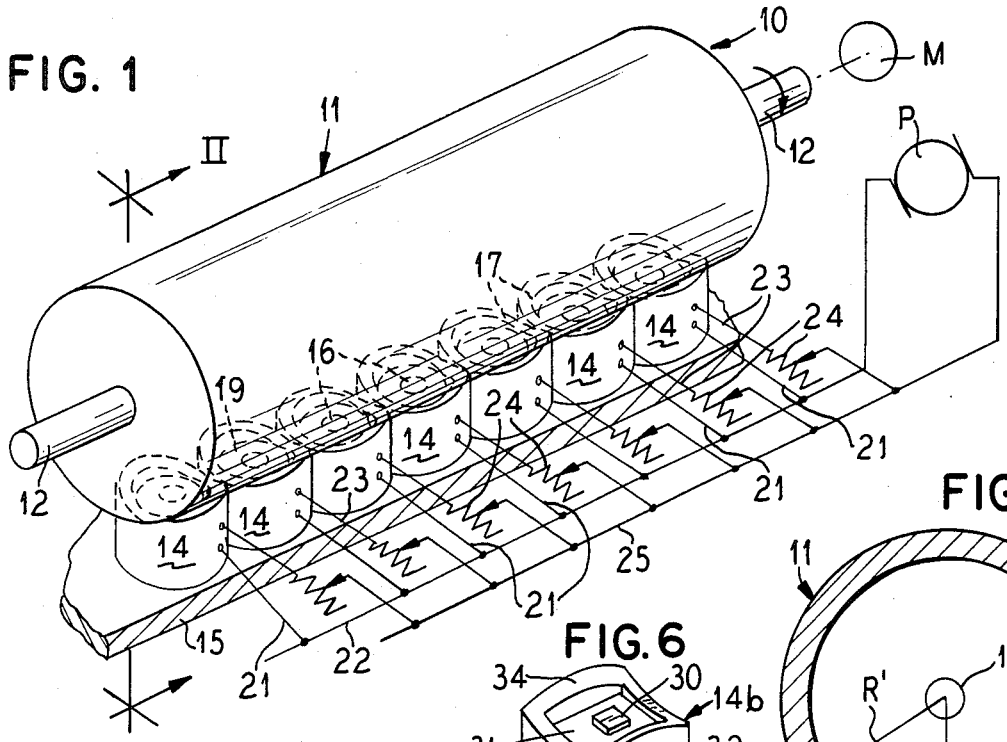
FIG. 2
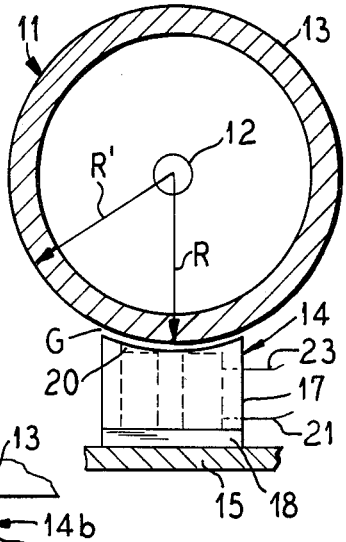
FIG. 6
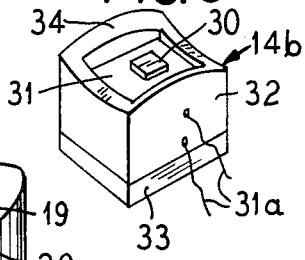
FIG. 3
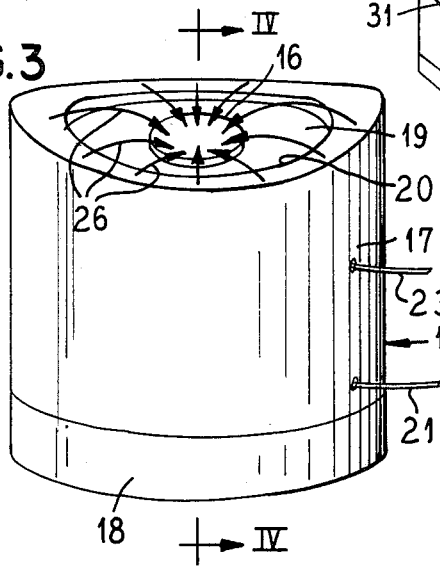
FIG. 7
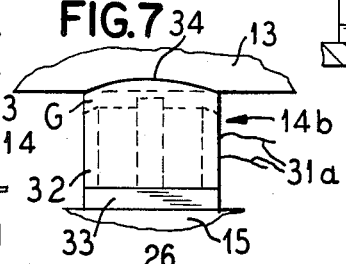
FIG. 5
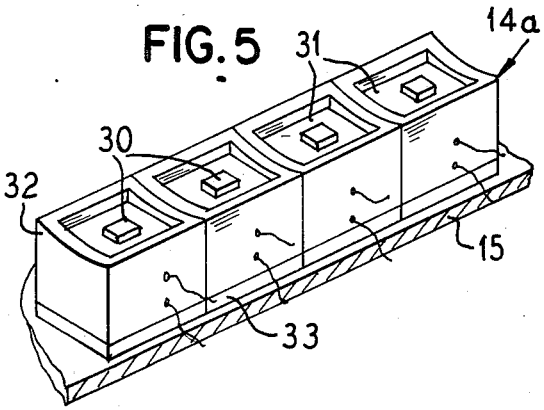
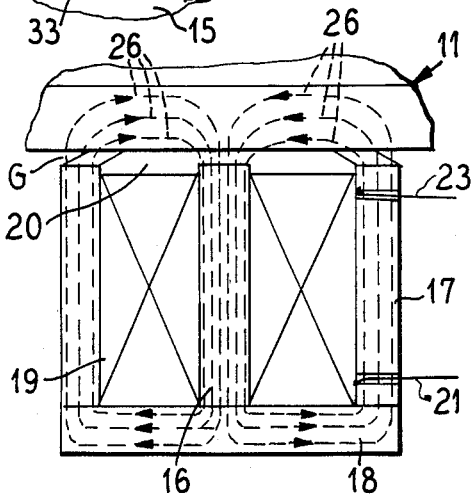
FIG. 4

INDUCTOR CONFIGURATION FOR EDDY CURRENT HEATING IN THE PAPERMAKING PROCESS

FIELD OF THE INVENTION

This invention relates to the art of heating rollers for rolling mills along the length thereof by electromagnetic induction and specifically deals with improved configurations for electromagnets to generate concentrated flux fields through the zone of the roll surface to be heated.

THE PRIOR ART

Electromagnetic induction has been used to heat ferromagnetic rolls at zones along the length thereof for distributing temperatures of the roll surface as desired. The prior known inductors require much of the flux to flow across air gaps thereby greatly reducing the efficiency of the heating and increasing the required current input to generate the desired heat. The exciting coils of these electromagnets were usually wound around core fingers and were exposed beyond the fingers. Flux lines or fields created by these arrangements were linear between laterally spaced core legs and had to pass through long air gaps before reaching the metal roll or were lost entirely to the air thereby greatly diminishing the effective heat output of the inductors. Further, the space beyond the cores occupied by uncovered excited coils prevented positioning of the inductors closely adjacent each other where they might be needed to compensate for temperature variation along the length of the roll.

It would, therefore, be an improvement in this art to provide electromagnetic inductors having core and coil configurations generating a controlled confined annular flux pattern through an adjacent roll without appreciable loss of flux to the air.

SUMMARY OF THIS INVENTION

According to this invention, electromagnetic inductors for heating rolls have the exciting coils wound around a center leg and completely surrounded by an outer leg joined at one end to the center leg. The shapes of the core legs and surrounding core envelopes can be varied as desired to meet specific installation requirements, but are preferably circular, although, square, rectangular, oval, and polygonal configurations are useful. The cores have open slots or gaps between the inner and outer legs and the end faces of these legs can be arcuately convex in the machine direction to fit closely adjacent the roll surface to be heated. These ends, for example, can be struck from a radius centered on the axis of the roll to uniformly overlie that portion of the roll surface to be heated with the gap between the conforming surfaces just sufficient to accommodate passage of the sheet material passed around the roll. The flux pattern is thus annular between the inner and outer legs directly through the adjacent roll with practically no flux lines laterally of the outer leg so that all of the magnetic field only has to pass through a very narrow gap between the core and the roll.

If it is desired to provide a heating pattern where the zone or band of the roll heated by an inductor is varied across its width, the cross machine contour of the roll confronting face of the inductor can be shaped to vary the gap through which the flux lines pass between the inductor and the roll. For example the end face of the inductor could be convex in the cross machine direction to induce more heat at its centerline where it is closer to the roll than at its longitudinal edges or sides.

The inductors can either create temperature differentials across the roll or compensate for surface temperature variations to control the moisture and/or caliper of a sheet treated on the roll.

The inductors are preferably arranged in a single row across the length of the roll to be heated and positioned so that their cores directly oppose the roll surface zone to be heated. The windings of the inductors can be excited at different levels to generate a desired temperature at the local areas which they overlie and the core configuration can be modified so that adjacent inductors can be placed in abutting side-by-side relation or spaced apart as condition demands.

It is then an object of this invention to provide electromagnetic inductor roll heaters having configurations preventing loss of flux to the air.

Another object of this invention is to provide electromagnetic inductor heaters for the rolls of rolling mills which generate a concentrated annular magnetic field through which the roll passes and is heated locally to either cause, or compensate for, variations in the surface temperature and surface contour across the length of the roll.

A specific object of the invention is to provide electromagnetic inductors for dryer rolls, press rolls, and calender rolls of papermaking machines and the like which have a coil wrapped center leg surrounded by an outer leg connected at one end to the center leg.

Another object of the invention is to provide heaters for causing, or correcting variations in temperature and diameter of metal rolls which are configured to concentrate magnetic flux lines directly through the roll surface with minimum loss to the air.

Other and further objects of this invention will become apparent to those skilled in this art from the following detailed description of the annexed sheet of drawings which, by way of best mode examples, show several embodiments of the invention.

ON THE DRAWING

FIG. 1 is an isometric schematic view of a roll and electromagnetic inductor heating assembly of this invention with variable current input to the inductors;

FIG. 2 is an end view along the line II—II of FIG. 1 showing the roll in section;

FIG. 3 is an isometric view of one of the inductors of FIGS. 1 and 2 showing the concentration of the flux path between the outer and inner legs of the core;

FIG. 4 is a cross sectional view along the line IV—IV of FIG. 3, but showing the flux path through the surface of the roll to be heated;

FIG. 5 is a fragmentary schematic isometric view of a modified configuration enabling the inductors to be mounted in full abutting side-by-side relation along the length of the roll to be heated;

FIG. 6 is an isometric view of one of the inductors of FIG. 5 modified to present a convex end face in the cross machine direction;

FIG. 7 is a fragmentary cross machine longitudinal side view showing the variation of the flux gap between an inductor of FIG. 6 and the roll.

AS SHOWN ON THE DRAWINGS

The assembly 10 of FIG. 1 includes a roll 11 of any electrically conductive material capable of conducting electromagnetic flux such as, for example, a ferromagnetic metal, particularly iron or steel. The roll 11 is rotatably mounted on end axles or journals 12, at least one of which is driven by a power source, such as a motor M, to rotate the roll. The roll 11 has a cylindrical metal surface 13 which may vary widely in diameter of say from 2 to 20 feet with a length to extend across the rolling mill, such as a paper machine, which it serves of say about 30 to 400 inches. This type of metal roll, in installations such as dryer drums, calender rolls, press rolls and the like in papermaking machines, is heated or becomes heated in use, but it is very difficult to control the heat and moisture profiling along the length of the roll to prevent development of undesired hot or cold circumferential bands and attendant variations in caliper or roll diameter which will, of course, vary the nip pressure along the length of the roll in installations where the roll confronts a cooperating nip forming member such as a press shoe or another roll. According to this invention, the roll surface 13 has localized circumferential zones or bands selectively heated by electromagnetic inductors 14 mounted in a row on a fixed, preferably steel base 15, along the length of the roll 11. The inductors 14 radiate from the roll surface with inboard ends closely adjacent the roll surface and outboard ends on the base 15 which, if composed of ferromagnetic material, can concentrate the flux lines to contain stray magnetic fields.

Each of the electromagnetic inductors 14, as better shown in FIGS. 3 and 4, has a core formed with a circular central upstanding circular post or leg 16 surrounded in spaced concentric relation by a cylindrical casing or leg 17 with a circular bottom disk 18 underlying the post and cylinder in integral relation therewith. The center post is thus nested within the outer leg of the core. The post 16, cylinder 17, and bottom 18, are composed of ferromagnetic material, such as iron, to form the core for the inductor 14. An exciting coil 19 for the electromagnet is wound around the center post 16 and fits snugly in the cylinder 17 filling the annular space between the post and cylinder from the bottom 18 to the open top 20.

As shown in FIG. 2, the open top 20 is contoured to closely embrace a cylindrical segment of the roll surface 13. Preferably this convex arcuate open top surface 20 is struck from a radius R on the same center line C of the radius R′ for the roll 11 as diagrammatically illustrated in FIG. 2. This surface 20 fits closely adjacent the roll surface 13 so that only a very narrow gap G, just sufficient to accommodate passage of the web material being conveyed on the roll 13, will be present.

The wire coil 19 has its ends connected to an electric power source, such as a generator P, as illustrated in FIG. 1, with one end 21 of each coil directly connected to a power line 22 and the other end 23 connected through a variable resistor 24 to the other power line 25. The coil 19 of each inductor 14 can thus be individually excited to control the intensity of the magnetic field or flux generated by the inductor.

The variable resistance method of exciting the inductors can be replaced with other methods such as a D.C. power supply with computer controlled capabilities to control current input. Another useful method is to provide a high frequency A.C. power supply.

As shown in FIGS. 3 and 4, flux lines flow in a confined annular path from the cylinder 17 which forms the outer leg of the electromagnetic core outwardly across the narrow gap G into the roll 11 passing through the roll surface 13 and then returning through the center post 16 forming a center leg and through the connecting bottom 18 back to the outer leg 17. These flux lines are diagrammaticallly illustrated at 26 by dotted lines with arrows showing the flux pattern as completely concentrated within the cylindrical contour of the inductor 14. Little or no flux lines are lost to the air beyond the configuration of the inductor 14. Since the gap G follows the contour of the roll and is very narrow, these flux lines only pass through a very limited non-magnetic zone to create the magnetic force between the inductor and roll. As the roll rotates through this magnetic field the desired heat is generated at the exact zone encompassed by the concentrated field.

As shown in FIG. 1, the cylindrical inductors 14 are selectively positioned along the length of the roll surface 13 as desired to heat localized circumferential bands of the surface for correcting temperature and caliper variations as needed.

As shown in FIG. 5, modified inductors **14*a* have a square configuration with a square center post or leg 30 having the coil 31 wrapped therearound and snugly seated in a square outer envelope or leg 32. The coils have end wire portions 31*a* for connecting to an energizing current such as shown in FIG. 1. The center post 30 and the outer envelope 32 are connected by a square bottom 33. This core configuration adapts the inductors 14*a* for mounting in side-by-side abutting relation to close up any gaps that might be created between cylindrical inductors even though the cylinders are abutted in side-by-side relation. The flux fields of these inductors will be concentrated in annular zones as illustrated in FIGS. 3 and 4**.

FIGS. 6 and 7 illustrate further modified inductors **14*b* of the general type shown in FIG. 5 and having corresponding components marked with the same reference numerals as the inductors 14*a*. However, where the inductors 14*a* have concave arcuate end faces to wrap closely around the roll and described in connection with the inductors 14, the further modified inductors 14*b* have these concave arcuate end faces convexly contoured at 34 in the cross machine direction thus varying the flux gap between the end face and the roll 13. As illustrated in FIG. 7, the gap $G_1$ will be greater at the sides of the inductor in the cross machine direction than at the center thereof. This variation of the gap is useful in creating a temperature differential across the band area of the roll 13** heated by the inductor. The curvature of the convex surface can vary to suit conditions.

In other arrangements, not shown, the center posts or center legs and the outer legs can be of elongated oval, rectangular, or polygonal shapes to suit the specific installation. These arrangements will also preferably have the concave faces in the machine direction immediately confronting the roll surface to be heated and can, of course, be arcuately convex in the cross machine direction. Other inboard end face configurations are available to provide a desired heat input pattern to the roll.

It will be understood by those skilled in this art that many variations from the illustrated embodiments are available without departing from the scope of this invention.

We claim:

1. In a machine for treating material moving therethrough in a machine direction having a cylindrical roll of magnetic flux conducting material, the improvement of an induction heater for said roll which comprises a core having a center leg, an outer leg completely surrounding and radially spaced from said center leg and a connecting leg at the end of the center and outer legs remote from the roll, an exciting coil wrapped around the center leg filling the space between the inner and outer legs and having ends adapted to be connected to a power source, said center and outer legs having free inboard end faces confronting the roll and contoured cooperatively with the surface of said roll to provide a desired heat input pattern to the roll, said free inboard end faces being concave in the machine direction of the roll and convex in the cross machine direction of the roll such that said faces partially surround an arc of the circumference of said roll to provide the desired heat input pattern to the roll.

2. The heater of claim 1 wherein the connecting leg closes the space between the center and outer legs.

3. The heater of claim 1 wherein the center and outer legs are concentric.

4. The roll assembly of claim 1 wherein the flux zone of each heater is annular.

5. The inductor of claim 1 wherein the end faces are struck from a radius centered on the axis of the roll to be heated.

6. A roll assembly for papermaking machines for treating a web moving therethrough in a machine direction which comprises, a cylindrical roll of magnetic flux conducting material, a row of induction heaters mounted along the length of said roll, each heater having a core composed of an inner leg, an outer leg completely surrounding the inner leg in spaced relation therefrom and an outboard end leg connecting the ends of the inner and outer legs, an exciting coil wound around the inner leg and snugly fitting in the outer leg, said core having an arcuate inboard end closely adjacent the roll surface remote from the connecting outboard end, means for electrically exciting the coil of each heater to create a magnetic flux through the roll surface confined to a zone immediately adjacent each core, and means for rotating the roll through said zones, the outer legs of adjacent heaters in the row being flat and abutted together and said heaters being disposed in said row for operating in combination with said roll for heating said roll across its entire cross-machine direction of said papermaking machine.

7. The roll assembly of claim 6 including means for independently electrically exciting each coil.

8. The roll assembly of claim 6 wherein the heaters are mounted in side-by-side relation in said row.

9. The roll assembly of claim 6 wherein the magnetic flux zone of each induction heater is annular.

10. The inductor of claim 6 wherein the end faces are struck from a radius centered on the axis of the roll to be heated.

* * * * *